US005209487A

United States Patent [19]

Rizzo

[11] Patent Number: 5,209,487

[45] Date of Patent: May 11, 1993

[54] BOARD GAME BOX

[75] Inventor: John J. Rizzo, Staten Island, N.Y.

[73] Assignee: Pyram Enterprises Inc., Richmond Hill, N.Y.

[21] Appl. No.: 789,097

[22] Filed: Nov. 7, 1991

[51] Int. Cl.[5] ..... A63F 3/00

[52] U.S. Cl. ..... 273/248; 273/148 R; 206/315.1; 206/579

[58] Field of Search ..... 273/248, 249, 285, 148 R; 206/315.1, 579

[56] References Cited

U.S. PATENT DOCUMENTS 925,142 6/1909 Spillman ..... 273/249

4,377,287 3/1983 Erwin ..... 273/252

OTHER PUBLICATIONS

"A History of Board Games", by H. J. R. Murray, Oxford at the Clarendon Press, 1952, p. 15.

*Primary Examiner*—Benjamin H. Layno

*Attorney, Agent, or Firm*—Bauer & Schaffer

[57] ABSTRACT

There is disclosed a game comprising a game board provided with a plurality of holes distributed in a pattern and consecutively numbered from 1 to 29, a plurality of game pieces to be moved along the pattern of the holes and also an appropriate box in the form of a sphinx for storing the game board, game pieces and other materials which are used with the game.

5 Claims, 3 Drawing Sheets

BOARD GAME BOX

This invention relates to a game, game board for playing the game and a box used in combination with the game board for storing the various game pieces and the like employed in playing the game.

BACKGROUND OF THE INVENTION

Many games have had their origin in pre-historic times. One such game, referred to now as "hounds and jackals" is one of those games which is not played today because its details in both structure and rules have been lost in antiquity, although apparently it had both amusement and educational attributes. It is an object of the present invention to resurrect "hounds and jackals" by providing modern means such as a game board, game pieces and other materials to accomplish the aims and purposes of the game. It is a further purpose of the invention to provide an enjoyable and popular game. In particular, it is an object to develop a new game, game board and attractive packing therefor.

These objects and advantages together with others will be apparent from the following disclosure.

BRIEF STATEMENT OF THE INVENTION

In accordance with the invention there is provided a game comprising a rectangular game board having a plurality of holes disposed therein in accordance with a specific pattern. A plurality of game pieces adapted to fit into the holes of the game board and to be moved therein in response to numbers thrown on a plurality of especially numbered dice until all of the game pieces of at least one player reach the last hole. The game board also has a plurality of markings or instructions located thereon at certain of the holes, whereby the forward process of movement of the game pieces is reversed, or the player throwing the dice is granted repetitive throws.

In addition, the invention also includes the combination of a box in the form of the sphinx for holding the game board, game pieces and other related items used in playing the game.

Full details of the present invention are set forth in the following description and illustrated in the accompanying drawing.

IN THE DRAWINGS

DESCRIPTION OF THE PREFERRED EMBODIMENTS

Figure 1:
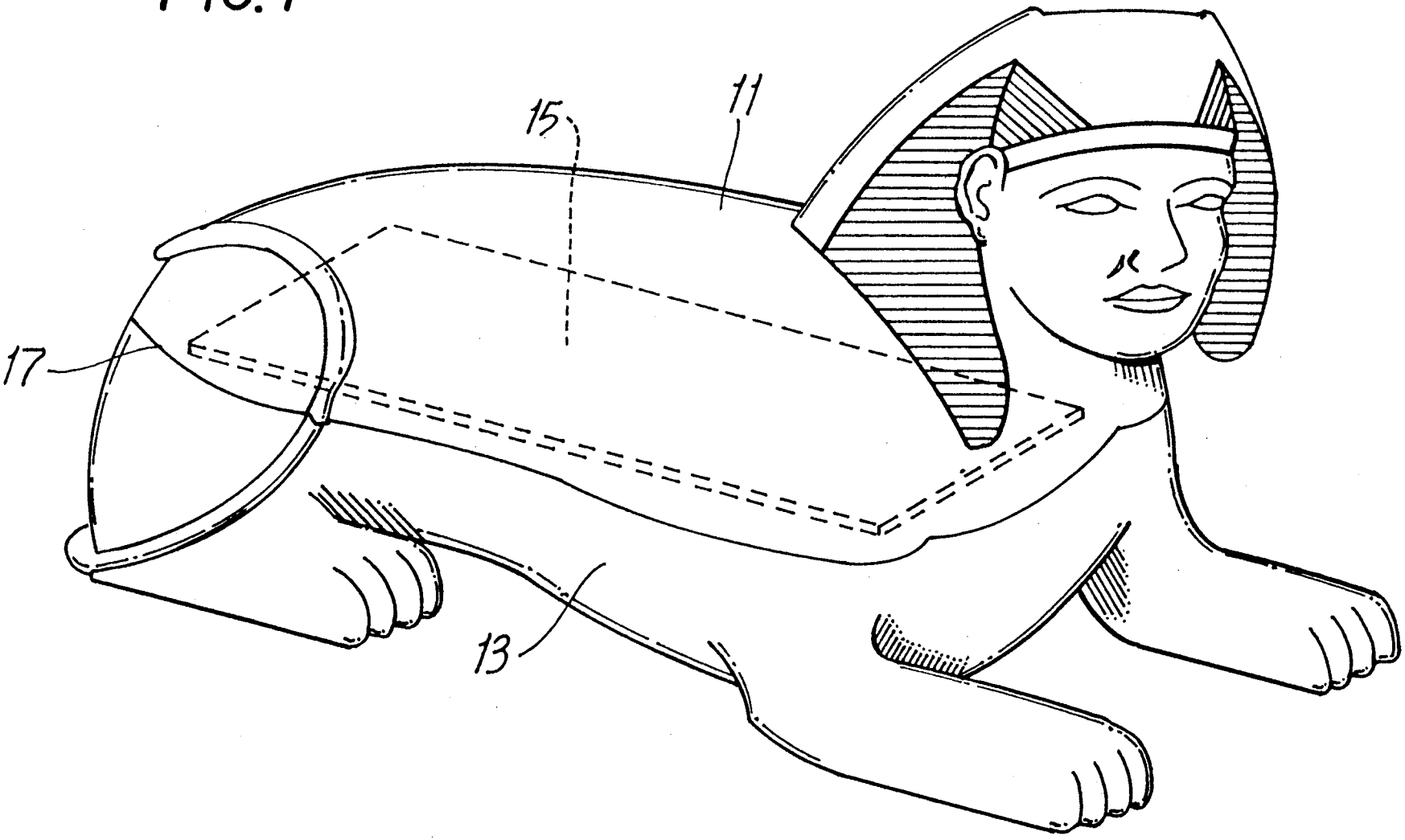
FIG. 1 is a view in perspective of the box in the form of the sphinx which have top and bottom members and is used for holding the game board, game pieces and other paraphernalia employed with the game and showing the game board in broken lines as stored in the box.

Referring now to FIG. 1, the box for the game board, game pieces and other items used in playing the game is in the shape of the sphinx and comprises an upper member or top 11 and a bottom member 13 which mates with the top member. The box may be made of a wide variety of materials, such as wood plastics or metals or combinations of wood plastics and metals, although from a cost view painted plastics are preferred.

Among useful, moldable plastics are polyethylene, polyurethanes, polyesters, polyamides, polyesteramides and the like, with moldable polyethylene being preferrred.

As seen in FIG. 1, the game board 15 shown in broken lines is stored inside the sphinx when not in use and the top member 11 is provided with a depending skirt 17 disposed over the upper portion of the of the lower box member 13.

Figure 2:
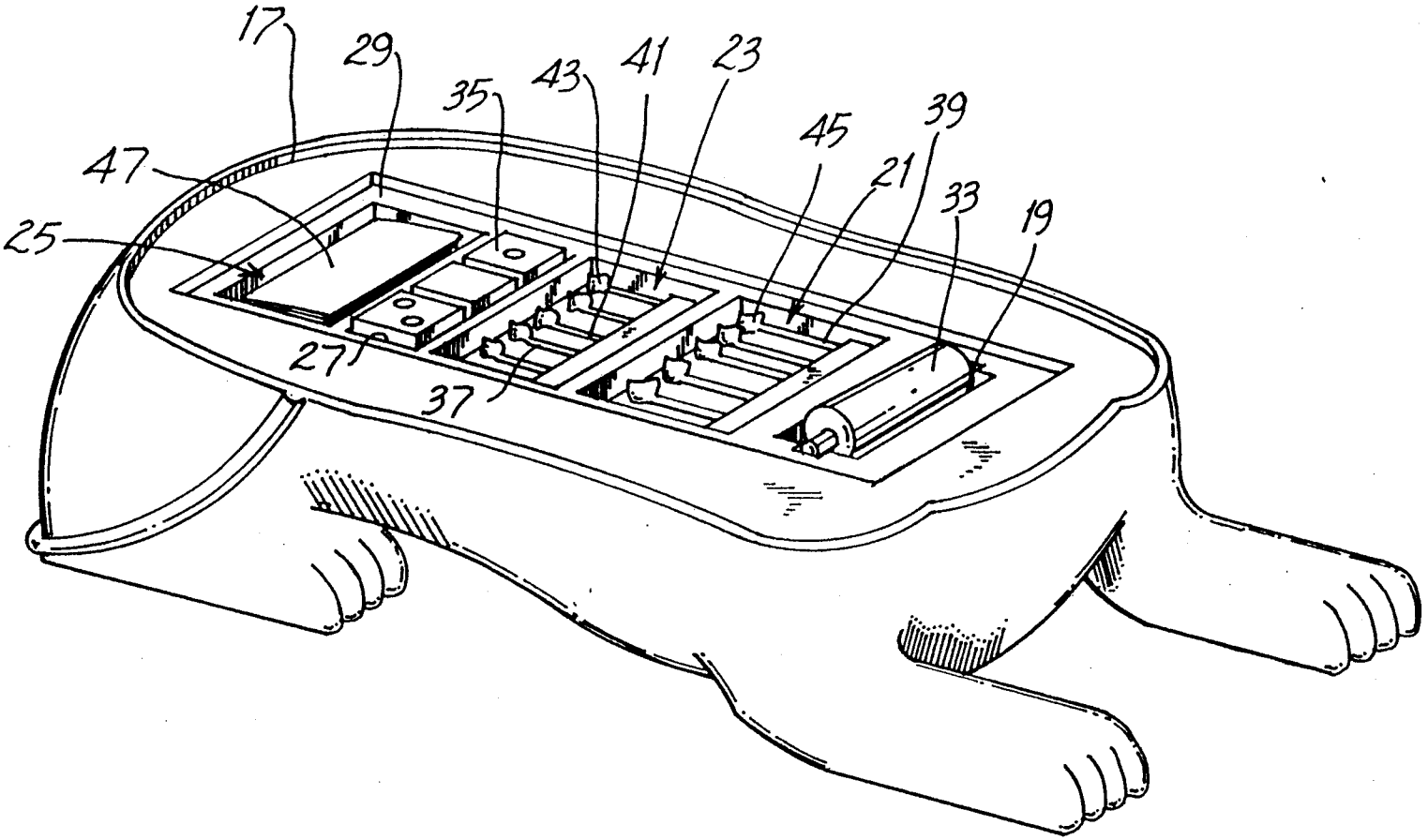
FIG. 2 is a plan view of the bottom half of the sphinx showing the compartments formed therein and the game pieces and other paraphernalia disposed therein as well as the grooves in which the game board is supported in the box and FIG. 3 is a plan view of the game board used in the game according to the invention.

As shown in FIG. 2 the lower member 13 of the box is provided with a plurality of compartments 19, 21, 23, 25 and 27 which are simply formed by molding or in any other convenient manner. The lower member 13 is also provided with a pair of spaced parallel grooves 29 located in the side walls of the bottom member just above the top of the above described compartments.

In keeping with the theme of a sphinx box or container, the compartments of the lower member of the box contains a scroll 33 having set forth therein the rules for playing the game, three dice 35, and ten game pieces, collectively identified by numerals 37 and 39.

The game pieces comprise pegs having a shaft 41 sized to fit the holes in the game board 15, as more fully explained hereinbelow. In addition, one half of the number of game pieces are provided at one end with the head of a jackal 43, while the other game pieces are provided at one end with the head of a hound 45. Finally, one of the compartments also holds a small brochure 47 containing a brief allegorical history about the sphinx, hounds and jackals.

Figure 3:
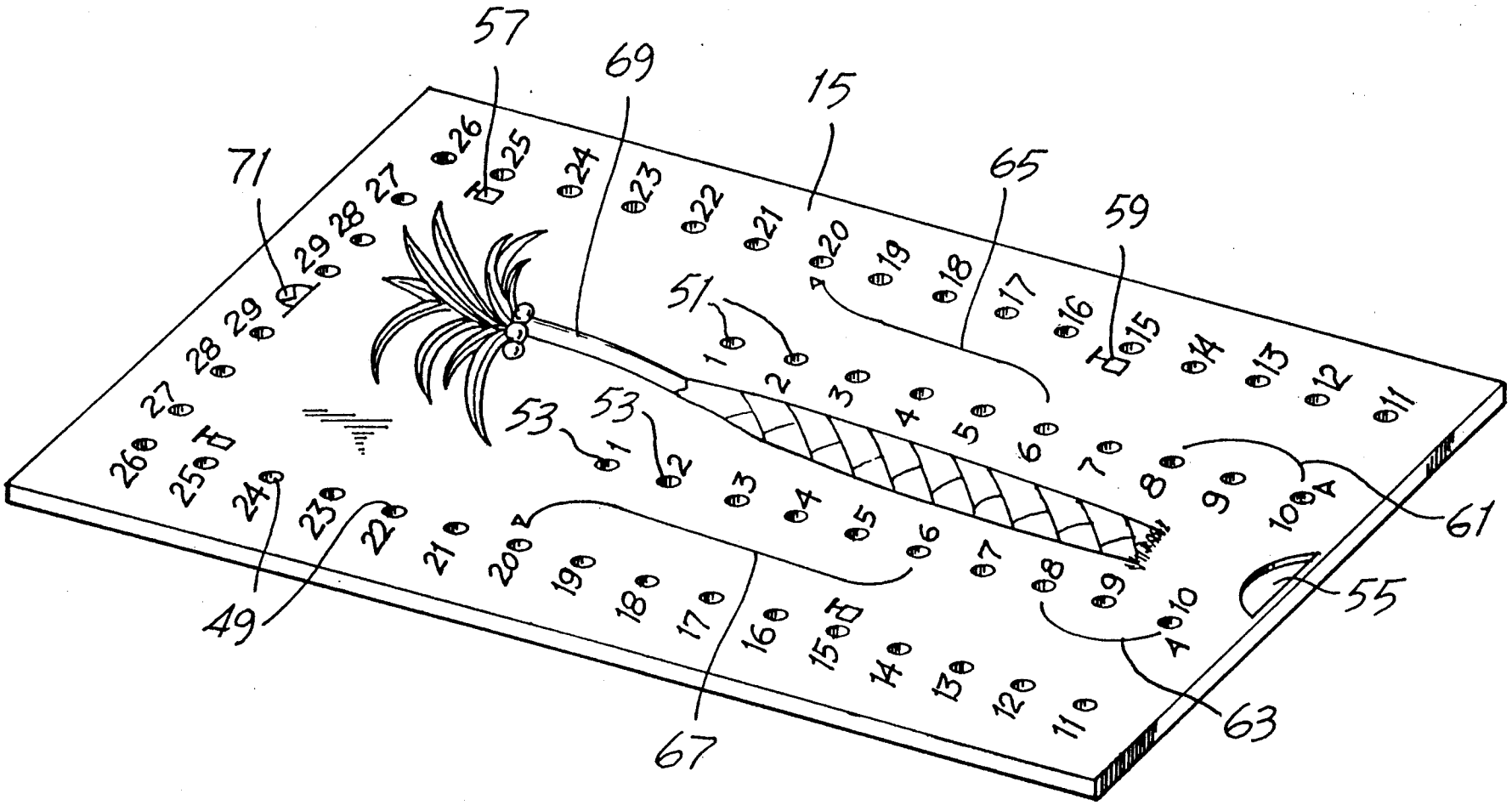

Next referring to FIG. 3, as mentioned previously, the game board 15 is provided with a plurality of holes such as 49 located in a rectangular pattern around and in the vicinity of the peripheral edges. Each of the holes 49 are sized to accommodate the shaft 41 of the game pieces. Still further, a plurality of holes 51 and 53 are set in two spaced parallel lines 51 and 53 are located in board 15 on both sides of an axial center line bisecting the board. These last mentioned lines of holes 51 and 53 are consecutively numbered from 1 to 10 and the holes 49 disposed in the peripheral pattern are numbered 11 to 29.

Board 15 is also provided with a gripping tab 55 and when assembled in combination with the sphinx box, the board 15 is slid into the grooves 29 along the sides of the box thus forming a cover for the compartments thereof and securing the game pieces and other items within their comparments 19 to 27. The upper member of the box is placed over the lower member 13 with the skirt 17 surrounding snuggly the upper outer surface of the lower member, thus providing a completely enclosed hollow sphinx for the game board and related items.

Board 15 is also provided with legendary material 57 or symbols 59, the former giving directions for repetitive throwing of the dice when a game piece lands in the hole designated by a legend 57 and when landing in the hole 59 interrupting the forward progress of a game piece landing therein and returning the same to a lower numbered hole connected by lines such as 61, 63, 65 and 67.

The board may be made of any suitable material such as plastic or stiff paperboard and decorated with fanciful designs or the like such as the palm tree 69.

Three dice 35 are provided each having two blank sides, two sides with one dot (value=1) each and two sides with two dots (value=2). In this manner the value of any given throw would lie between 0 and 6. Consequently, the game is balanced between the players and kept close before the objective is reached by either player.

In using the game board and sphinx box combination of this invention, a user removes the upper box member to expose the game board located in the lower box member. The game board is then withdrawn from the lower member by grasping the tab 55 and sliding the board out of its position in the grooves, thus exposing the game pieces and other items located in the compartments of the lower box section or member.

Two players then select a five game piece set of hounds or jackals and place them in the holes number 1 through 5. Each player then throws the three dice and moves his game piece the approximate number of holes, as indicated by the dice. Should the total number thrown be 3, for example, the player moves the game piece from hole numbered 5 forward three holes, that is to hole 8. Should the total thrown then be five, he moves his game piece ahead by this number. The second player then throws the dice and moves his game piece the total number of holes indicated by the dice. Such manipulation of the game pieces on the board is then repeated until all of one player's five game pieces have reached the victory sign 71 and that player wins the game. Various penalties and rewards may be provided during play. For example, should a player land on holes numbered 10 and 20, respectively, he would be penalized a number of spaces returning him to earlier hole indicated by the arrows 61, 63, 65 and 67. Should the player land on holes 15 and 25, he would be rewarded by an advance move by a predetermined number of spaces. Other madifications can also be made.

In the preferred form of the game the playing surface of the board have two sets of twenty-nine holes 29, commencing on either side of an engraved palm tree. The hole 29 leads by a circular route to the top of the palm tree marked by a sign V (victory). The aim of the game is to reach this point. To set the game up for play five hound pegs 45 are set in the first five holes on the left side of the palm tree. Then a set of five jackal pegs 43 are set in the first five holes on the right side of the palm tree. To see who makes the first move, the dice are rolled and the higher number rolls first. The dice are rolled alternately to advance the lead peg by one, two, three, four, five or six holes. Penalties are assessed at tenth and twentieth holes bearing the syumbol 59 requiring the player to follow the line back to six. If you land in hole mark bearing the legend 57 at the fifteenth and twenty-fifth, the player rolls again ahead of his opponent. The first player to land in the twentyninth hole at the top of the palm tree wins the race and the opponent player forfeits his piece. Thereafter, each opponent repeats the process for the next peg of the initial 5. The object of the game is to win as many races to the V as a player can and take all your opponent's pieces. The winner is determined by the number of pieces accumulated.

The game, game board and box of this invention presents many advantages. For example, they may be made of readily available and inexpensive materials. The game is simple to play, yet presents relatively challenging affects of chance in order to complete the run of all five game pieces per player.

On the other hand, the game is simple enough to be used by children, as well as being amusing to them and to adults, while at the same time providing educational benefits due to the brochure on the history of the sphinx, hounds and jackals. Still further, the sphinx box presents an esthetically pleasing container which safely and securely keeps the game board and other items together for future use. The box may be kept quite visible, as in a bookcase, on a mantlepiece or as the centerpiece of a table.

Various modifications and changes have been described and others will be obvious to those skilled in the art. Accordingly, it is intended that the present disclosure be taken as illustrative only and not limiting the scope of the invention.

What is claimed is:

1. In combination, a box in the form of the sphinx and a game board for storage in said box, said box comprising a top member and a bottom member, said bottom member having a plurality of compartments for holding a plurality of game pieces in the form of shafts having the heads of hounds and jackals, on one end thereof a plurality dice, a scroll having game rules set forth thereon, and a brochure having set forth thereon a history of said sphinx, hounds and jackals, said bottom member of said box being provided with a pair of spaced, longitudinal grooves located above said compartments along the sides of said bottom member for the reception of a rectangular game board which also acts as a closure means for said compartments, and said top member having a shape which mates with the shape of said bottom member and a downwardly depending skirt which fits over the upper edge of said bottom member.

2. A combination according to claim 1, wherein the game board has a plurality of holes disposed therein in a rectangular pattern near the peripheral edges thereof and a pair of parallel lines of a plurality of holes disposed therein on each side of an axial line bisecting said game board, the holes of each line of said parallel lines of holes being numbered from 1 to 10 and the holes disposed in said rectangular pattern near each of the peripheral edges of said game board which are parallel to the holes numbered 1 to 10 and perpendicular to said holes being numbered from 11 to 29, the shafts of the plurality of game pieces being sized to fit into the holes in said game board and be moved therein in response to numbers thrown on the dice until all the game pieces of at least one player reach the twentyninth hole, and a plurality of markings located on said game board, whereby the forward progress of movement of said game pieces is reversed or the player throwing said dice is granted repetitive throws.

3. A combination according to claim 1, wherein the game pieces are five in number for a player.

4. A combination according to claim 1, wherein the box is formed of plastic.

5. A combination according to claim 4, wherein the plastic is polyethylene.

* * * * *